United States Patent [19]

Champlin et al.

[11] 4,385,695

[45] May 31, 1983

[54] PACKAGING BLOCK FOR CYLINDRICAL ARTICLES

[76] Inventors: Bruce E. Champlin, 3125 Smart Rd., Sault Ste. Marie, Mich. 49783; David M. Manthey, 34221 39th Ave., Auburn, Wash. 98002

[21] Appl. No.: 279,428

[22] Filed: Jul. 1, 1981

[51] Int. Cl.[3] ..... B65D 85/20; B65D 6/00; B65D 21/02

[52] U.S. Cl. ..... 206/443; 206/503; 206/821; 220/4 E; 220/23.6

[58] Field of Search ..... 206/443, 821, 503, 511, 206/512; 220/4 B, 4 E, 23.4, 23.6; 312/111

[56] References Cited

U.S. PATENT DOCUMENTS

| | | | |
|---|---|---|---|
| Re. 30,373 | 8/1980 | Nist, Jr. | 206/443 |
| 2,582,553 | 1/1952 | McMurtrie | 312/111 |
| 2,849,027 | 8/1958 | Tetyak | 138/48 |
| 2,850,182 | 9/1958 | Tetyak | 138/106 |
| 2,990,951 | 7/1961 | Fallert | 206/65 |
| 3,055,398 | 9/1962 | Tunnessen | 138/111 |
| 3,294,225 | 12/1966 | Kenyon | 138/96 R |
| 3,590,752 | 7/1971 | DePew | 108/53 |
| 3,655,065 | 4/1972 | Yellin | 312/111 |
| 3,757,388 | 9/1973 | Wolny | 220/4 E |
| 4,099,617 | 7/1978 | Nist, Jr. | 206/443 |
| 4,099,626 | 7/1978 | Magnussen, Jr. | 221/60 R |
| 4,195,732 | 4/1980 | Bell | 206/391 |

FOREIGN PATENT DOCUMENTS

| | | | |
|---|---|---|---|
| 56217 | 7/1967 | Fed. Rep. of Germany . | |
| 2208139 | 8/1973 | Fed. Rep. of Germany . | |
| 411694 | 11/1966 | Switzerland | 220/4 E |

*Primary Examiner*—William Price
*Assistant Examiner*—Brenda J. Ehrhardt
*Attorney, Agent, or Firm*—Basile, Weintraub & Hanlon

[57] ABSTRACT

A packaging block for cylindrical articles includes first and second identical L-shaped members adapted to be secured around the cylindrical article. Each member is formed with first and second substantially perpendicular legs having a semi-circular concavity formed in the interior contiguous surfaces of the legs. A boss is formed at one end of the first leg and extends outward therefrom. A correspondingly shaped groove is formed at the end of the other leg and extends substantially parallel to the boss. The first and second members are adapted to be disposed in an opposed, inverted manner around the cylindrical article with respective bosses urged into the corresponding grooves of the opposed members to interconnect the first and second members around the cylindrical article. Bores formed in each of the first and second members receive interconnecting pins to align adjacent packaging blocks in rows and tiers to form a complete bundle.

5 Claims, 4 Drawing Figures

PACKAGING BLOCK FOR CYLINDRICAL ARTICLES

BACKGROUND OF THE INVENTION

1. Field of the Invention

This invention relates, in general, to packaging apparatus and, more specifically, to packaging apparatus for cylindrical, rod-like articles.

2. Description of the Prior Art

The handling of cylindrical, rod-like articles, such as pipe, for storage and shipping has always posed considerable problems due to the propensity of the pipe for movement. These problems have mushroomed in proportion of late due to the increased use and shipping of pipe, particularly in the exploration and drilling of oil wells.

What is needed is a packaging system for cylindrical, rod-like articles, such as pipe, which enables the articles to be conveniently stacked for storage and handled in bundles or groups for transport and which prevents damage to the articles by spacing the articles apart in each bundle.

The prior art has attempted to meet these needs by using concave pipe shoes in which one shoe underlies the pipe, which is then capped with a similar, but inverted shoe and the whole assembly fastened together.

It is also known to provide elongated load racks having U-shaped or concave depressions formed along their length to cradle the cylindrical articles. Again, a like but inverted rack is placed over the articles and the entire assembly secured together by banding straps.

Finally, it is known to form a shipping bundle including a plurality of elongated, horizontal bars which sandwich the pipe therebetween in rows; with divider blocks having concave sides disposed between the adjacent pipes in each row. The entire bundle is then secured together by fastening straps.

However, such prior art packaging apparatus for cylindrical, rod-like articles suffer several deficiencies. For one, prior art packaging apparatus utilize many separate, unconnected components which are individually mounted in the desired position as the cylindrical articles are arranged or stacked in bundles. This increases the time required to form the bundle of cylindrical articles and, during such stacking, the packaging apparatus provides little or no protection for the pipe from damage.

For another, such packaging apparatus requires straps as the sole means to secure all of the individual packaging components and pipe together in a unitary assembly; which again lengthens the loading time and increases the chances that difficulties will be encountered in forming the bundle due to the loose, unconnected arrangement of pipe and packaging components.

Thus, it would be desirable to provide a packaging block for cylindrical articles which overcome the problems of similar prior art packaging apparatus for cylindrical articles. It would also be desirable to provide a packaging block for cylindrical articles which is interconnected in a secure manner around each cylindrical article. It would also be desirable to provide a packaging block for cylindrical articles which is interconnected with adjacent identical packaging blocks to form a unitary bundle of cylindrical articles. Finally, it would be desirable to provide a packaging block for cylindrical articles which is formed of a minimum number of individual components.

SUMMARY OF THE INVENTION

The present invention comprises a packaging block for use with cylindrical, rod-like articles. The packaging block is formed of first and second identical, L-shaped members, each having first and second substantially perpendicular legs. A semi-circular concavity is formed in the interior contiguous surfaces of the first and second legs. A boss is formed at the end of one leg and extends outward therefrom. A correspondingly shaped groove is formed in the other leg parallel to the boss. The first and second members of the packaging block are adapted to be disposed in an opposed, inverted manner around the cylindrical article with the respective bosses urged into the corresponding grooves of the opposed member to interconnect the first and second members in a secure manner around the cylindrical article.

Bores formed in the legs of each of the first and second members are adapted to removably receive interconnected means to align adjacent pairs of packaging blocks during the formation of a bundle of cylindrical articles.

A central depression, in the form of a rectangular slot, is formed in the exterior surface of the first and second legs and is adapted to receive strap means therein to securely bind a plurality of packaging blocks together in a unitary bundle.

The packaging block of the present invention overcomes many of the problems of similar prior art packaging apparatus for cylindrical articles insofar as providing a packaging apparatus which contains a minimum number of individual parts. Further, the packaging block of the present invention may be easily and quickly secured around a cylindrical article and removed therefrom thereby simplifying the storage and unloading of the individual cylindrical articles from the complete bundle. In addition, the packaging block of the present invention is adapted to be interlocked in a secure manner around each cylindrical article which not only simplifies the stacking of the cylindrical articles into a bundle; but, also, provides increased protection from damage for the cylindrical articles during the loading and unloading process.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 2:
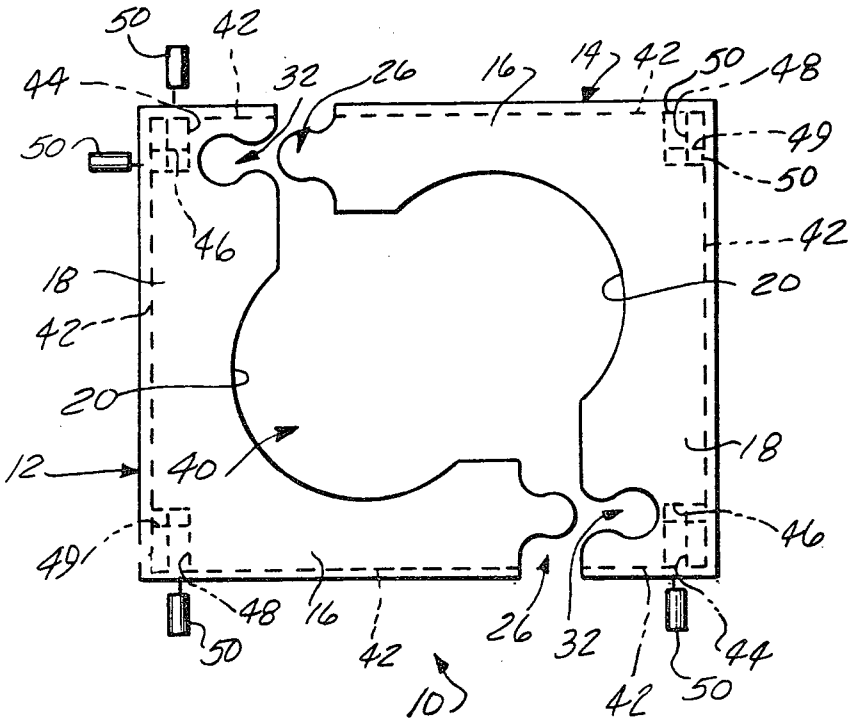
FIG. 2 is a front elevational view of the packaging block of the present invention.

Throughout the following description and drawing, identical reference numbers are used to refer to the same component shown in multiple figures of the drawing.

Figure 1:
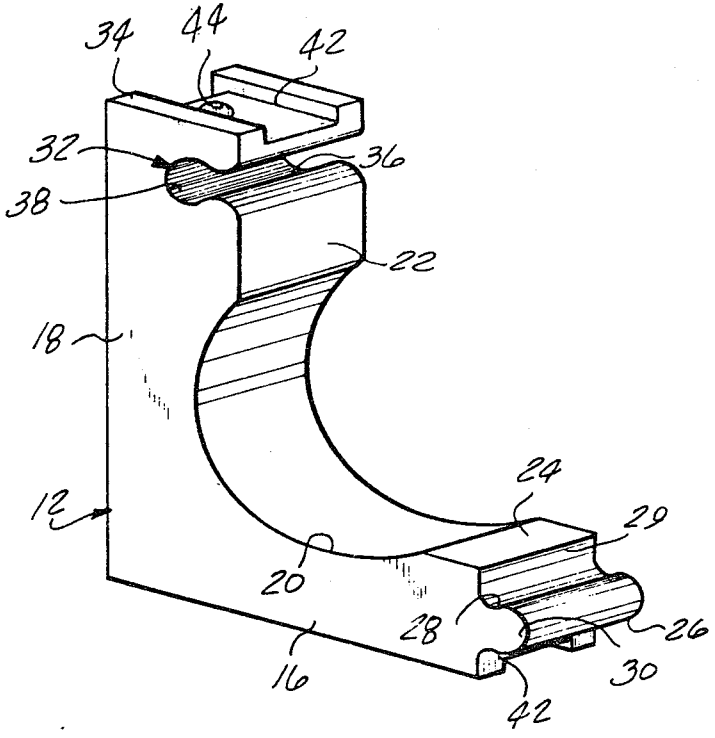
FIG. 1 is a perspective view of one of the identical members forming the packaging block of the present invention.

Referring now to the drawing, and to FIGS. 1 and 2 in particular, there is illustrated a packaging block 10 adapted for use in storing and transporting cylindrical, rod-like objects, such as pipe. The packaging block 10 is adapted to be disposed at spaced intervals along the length of the cylindrical articles and stacked to form tiers or a bundle of such cylindrical articles.

The packaging block 10 of the present invention comprises first and second identical, inverted, interconnected members 12 and 14, respectively, which are adapted to be interlocked in a secure but removable manner around each cylindrical article.

As each of the first and second members 12 and 14 is identically constructed, the following description will be presented with respect to only one of such members, such as the first member 12.

The first member 12 is formed with first and second integral legs 16 and 18, respectively, which are perpendicularly disposed in a substantially L-shaped configuration. Each leg 16 and 18 is substantially square in cross section. A semi-circular concavity 20 is formed centrally in the interior contiguous surfaces of the first and second legs 16 and 18. The diameter of the concavity 20 is sized for the particular diameter of the cylindrical article with which the packaging block 10 is to be used. Thus, for example, concavities 20 having diameters ranging from four and twenty inches may be formed. As shown in FIG. 1, interior flats 22 and 24 extend from the edges of the concavity 20 to the approximate ends of the first and second legs 16 and 18, respectively.

A boss 26 is formed at the end of one of the legs, such as the first leg 16, and extends in an outwardly direction substantially in line with the longitudinal axis of the first leg 16. The boss 26 is formed in a substantially tear drop configuration having a narrow first portion 28 integrally formed with the end 29 of the first leg 16 and an enlarged outer portion 30.

A correspondingly shaped groove or recess 32 is formed in the opposed or second leg 18 adjacent the end 34 thereof. The groove 32 extends inwardly into the second leg 18 and is substantially parallel to the boss 26. The groove 32 is formed with a first narrow portion 36 and an expanded or enlarged interior 38 which is similar to the configuration of the boss 26.

According to the preferred embodiment, each of the first and second members 12 and 14 of the packaging block 10 is formed of a resilient material, such as a suitable plastic, to enable the first and second members 12 and 14 to be snapped or interlocked together. In this manner, a degree of resiliency is provided along the narrow first portion 36 of the groove 32 which enables the enlarged portion 30 of the boss 26 of the opposed member of the sides of the packaging block 10 to be urged therein, with the narrow portion 36 of the groove 32 expanding in an outward direction until the enlarged portion 30 of the boss 26 slides into the enlarged interior portion 38 of the groove 36. At this point, the narrow first portion 36 of the groove 32 snaps back to secure the boss 26 within the groove 32 and interlock the first and second members 12 and 14 of the packaging block 10 around the cylindrical article.

When the first and second members 12 and 14 are interlocked together, as described above, a central circular aperture 40, FIG. 2, is formed by the aligned concavities 20 in each of the first and second members 12 and 14. As noted above, the diameter of the central aperture 40 is sized to correspond to the diameter of the cylindrical article with which the packaging block 10 of the present invention is utilized.

As shown in FIGS. 1 and 2, each of the first and second members 12 and 14 has a central depression in the form of a rectangular slot 42 formed in the exterior surface of each of the first and second legs 16 and 18 as well as along the end 34 of the second leg 18. The slot 42 in each member 12 and 14 of the packaging block 10 is adapted to receive suitable strapping means for securing a plurality of packaging blocks 10 together in a bundle, as described in greater detail hereafter.

As shown in FIG. 2, a plurality of bores 44, 46, 48 and 49 are formed in each of the first and second members 12 and 14. The first bore 44, which is cylindrical in shape, is formed in the end 34 of the second leg 18 of each member 12 and 14. The second bore 46 is disposed substantially perpendicular to the first bore 44 in the second leg 18 and is located in proximity with the end 34 of the second leg 18. The third bore 48 is disposed in line with the first bore 44 but is located in the first leg 16. Finally, the fourth bore 49 is disposed perpendicular to the third bore 48 and is located in the second leg 18.

The bores 44, 46, 48 and 49 are adapted to slidingly receive interconnecting means 50 in the form of a tapered cylindrical pin which is adapted to align adjacent pairs of packaging blocks 10 together, as described hereafter.

Figure 3:
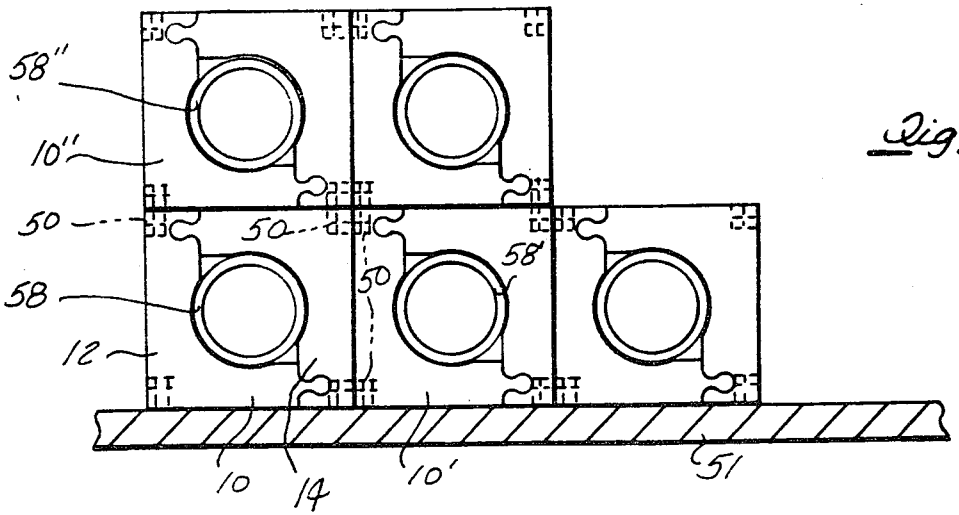
FIG. 3 is an elevational view of a plurality of packaging blocks of the present invention arranged in a stacked, interconnected configuration.

Referring now to FIG. 3, there is shown a plurality of identical packaging blocks 10 arranged in a tiered bundle arrangement. In forming a bundle, the first and second members 12 and 14 of each packaging block 10 are joined together around the cylindrical article 58 in the desired position along its length. With the first cylindrical article 58 and packaging block 10 disposed on a suitable loading or storage surface 51, the interconnecting pins 50 are inserted into the bores in the first packaging block 10. Another packaging block 10' may be then secured around a second cylindrical article 58' and moved into alignment with the first packaging block 10 until the interconnecting pins 50 slide into the bores in the second packaging block 10' to align and interconnect the two packaging blocks 10 and 10'. Similarly, a second row of packaging blocks and cylindrical articles may be formed by disposing a third packaging block 10'' on top of the first block 10 with the interconnecting pins 50 aligned between corresponding bores in the packaging blocks 10 and 10''. This process may be continued until the desired number of cylindrical articles have been arranged in a bundle or stacked configuration.

Figure 4:
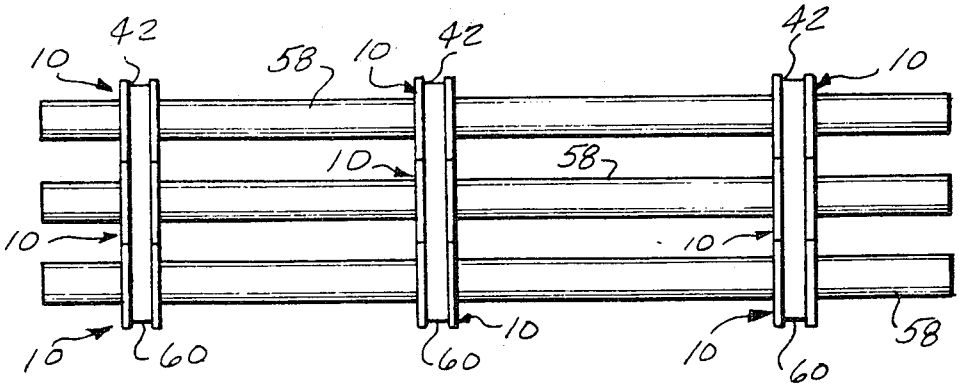
FIG. 4 is a side elevational view of a stack of cylindrical articles and interconnected packaging blocks of the present invention.

When the desired number of cylindrical articles 58 have been arranged in a stacked configuration, strapping means 60, FIG. 4, in the form of a suitable bundling strap, may be disposed through the aligned slots 42 in the stacked packaging blocks and secured at its ends to combine the cylindrical articles and packaging blocks secured thereto into a complete, unitary bundle which may be easily handled for shipping or storage. Thus, there has been disclosed a unique packaging block adapted for use with cylindrical, rod-like articles which is easy to use and enables a plurality of cylindrical articles to be arranged in stacks or a bundle for easy shipping, handling and storage. The packaging block of the present invention is adapted to be secured around each individual cylindrical article which simplifies the loading and unloading process as well as protecting the individual cylindrical article from damage during such handling.

What is claimed is:

1. In a packaging system for storing and transporting cylindrical articles, the improvement comprising a plurality of packaging blocks adapted to be secured around each cylindrical article at spaced intervals along the length thereof, each packaging block comprising:

first and second members each formed of a resilient material, each of the first and second members having first and second perpendicularly disposed legs and a semi-circular concavity formed in the interior contiguous surfaces of the first and second legs;

a boss formed at one end of the first leg of each of the first and second members and extending outward therefrom, the boss having a narrow first end portion and an enlarged outer end portion;

a groove formed in the end of the second leg of each of the first and second members and extending substantially parallel to the boss, the groove having an enlarged interior portion complementary to the outer end portion of the boss and a narrow end portion having side walls which yieldingly receive the boss of the other of the first and second members when the first and second members are disposed in an opposed, inverted manner around the cylindrical article to releasably interconnect the first and second members around the cylindrical article;

bores formed in the first and second legs of each of the first and second members; and pin means adapted to be removably and slidingly inserted into aligned bores of adjacent disposed packaging blocks to align the adjacent pairs in a stacked arrangement.

2. The improvement of claim 1 wherein each of the first and second members has a continuous slot formed in the exterior surface of the first and second legs; and strap means adapted to be disposed in the slot for binding a plurality of packaging blocks into a unitary bundle.

3. The improvement of claim 1 wherein the first and second members have a substantially square cross sectional configuration.

4. The improvement of claim 1 further including two pairs of perpendicularly disposed bores formed in the first and second legs.

5. A component for a packaging block for use with elongated cylindrical articles comprising:

a member formed of a resilient material and having first and second perpendicularly disposed legs;

a semi-circular concavity formed in the interior contiguous surfaces of the first and second legs of the member;

a boss formed at the end of the first leg and extending outward therefrom, the boss having a narrow first end portion and an enlarged outer end portion;

a groove formed at the end of the second leg and extending parallel to the boss, the groove having an enlarged interior portion complementary to the outer end portion and a narrow end portion having side walls which yieldingly receive the boss of an inverted like member and the boss being yieldingly received within the groove of the inverted like member to releasably interlock the members about the cylindrical article;

bores formed in the first and second legs of the member; and pins adapted to be removably and slidably inserted into aligned bores of adjacent disposed, interlocked members to align the interlocked members in a stacked arrangement.

* * * * *